United States Patent [19]

Rutishauser

[11] Patent Number: 4,717,136

[45] Date of Patent: Jan. 5, 1988

[54] PROCESS AND APPARATUS FOR FEEDING IN OF RECORDING CARRIERS TO THE WRITING ROLLER OF AN OFFICE MACHINE

[76] Inventor: Albert Rutishauser, Rütihofstrasse 38-40, 8713 Uerikon, Switzerland

[21] Appl. No.: 793,897

[22] Filed: Nov. 1, 1985

[30] Foreign Application Priority Data

Nov. 2, 1984 [EP] European Pat. Off. ..... 84113191
Nov. 2, 1984 [EP] European Pat. Off. ..... 84113192

[51] Int. Cl.[4] ..... B65H 3/44

[52] U.S. Cl. ..... 271/9; 271/110; 271/114; 271/242; 271/902

[58] Field of Search ..... 271/9, 21, 22, 110, 271/111, 114, 116, 902, 242; 400/624, 630

[56] References Cited

U.S. PATENT DOCUMENTS

| | | | |
|---|---|---|---|
| 3,894,624 | 7/1975 | Long . | |
| 4,248,415 | 2/1981 | Steinhilber | 271/116 X |
| 4,268,021 | 5/1981 | Rutishauser | 271/116 X |
| 4,509,734 | 4/1985 | Rutishauser | 271/10 |
| 4,516,764 | 5/1985 | Tamura . | |
| 4,544,294 | 10/1985 | Runzi | 271/116 X |
| 4,564,187 | 1/1986 | Costa | 271/114 X |
| 4,570,919 | 2/1986 | Huang | 271/114 X |

FOREIGN PATENT DOCUMENTS

| | | |
|---|---|---|
| 0101841 | 3/1984 | European Pat. Off. . |
| 297039 | 5/1914 | Fed. Rep. of Germany . |
| 2857074 | 8/1980 | Fed. Rep. of Germany . |
| 2950707 | 9/1980 | Fed. Rep. of Germany . |
| 58-211479 | 12/1983 | Japan . |
| 493889 | 6/1969 | Switzerland . |
| 11117 | of 1914 | United Kingdom . |
| 2132591 | 7/1984 | United Kingdom . |

OTHER PUBLICATIONS

IBM Technical Disclosure Bulletin, vol. 25, No. 3B, Aug. 1982—"Paper Straightner"—D. C. Estabrooks.

*Primary Examiner*—Richard A. Schacher
*Attorney, Agent, or Firm*—Cushman, Darby & Cushman

[57] ABSTRACT

A sheet feeding apparatus for use with a printing office machine includes at least one magazine, a drive wheel for removing a single sheet from the magazine and passing the sheet in a forward direction the nip of a printing wheel; the printing wheel is drivingly connectable with the separating roller and is driven in a forward direction to provide rotary power to the sheet feeder wheel to effect feeding of a single sheet to the nip; the method includes first driving the printing wheel in the forward direction and then reversing the direction of rotation of the printing wheel to move the sheet back out of the nip, the reverse rotation being disengaged from the separating wheel by a latch device.

6 Claims, 10 Drawing Figures

Fig. 2
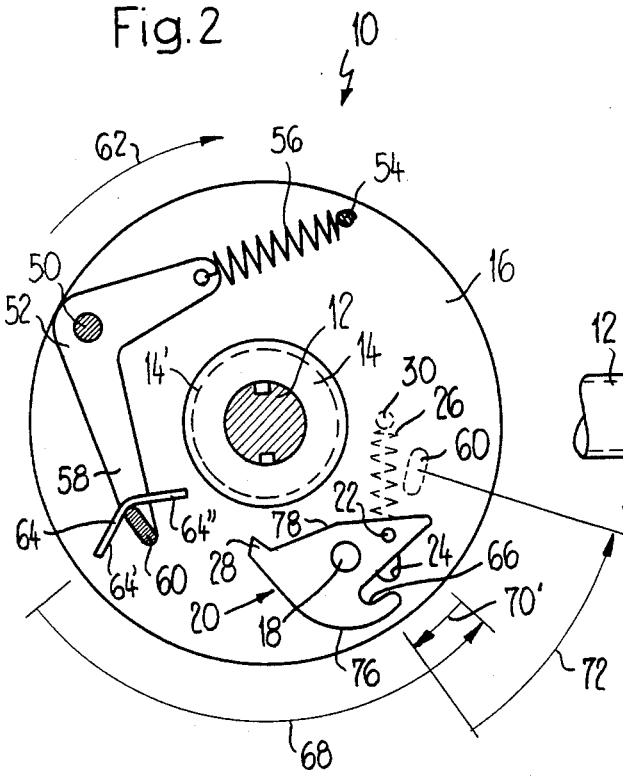
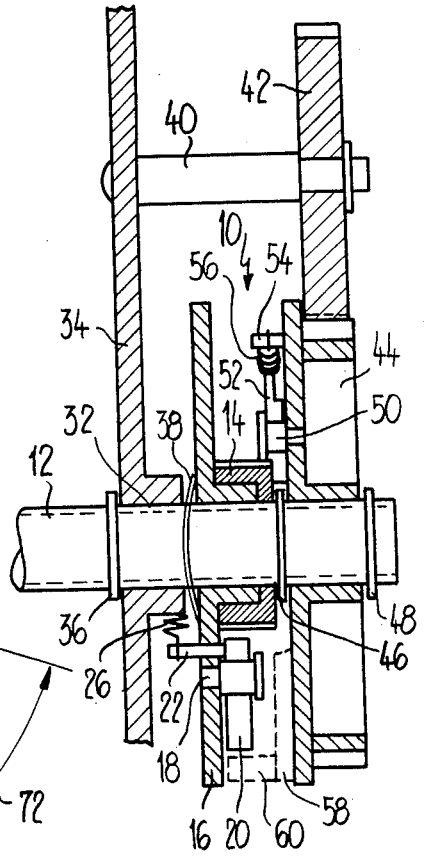
Fig. 3
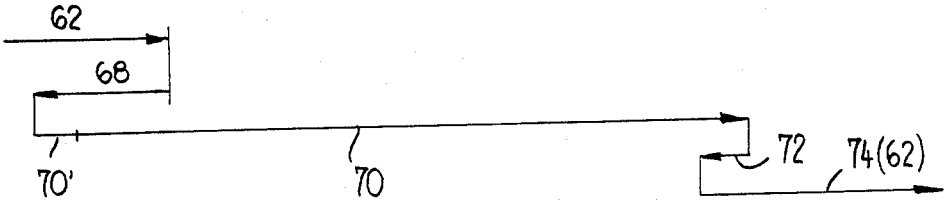
Fig. 4

PROCESS AND APPARATUS FOR FEEDING IN OF RECORDING CARRIERS TO THE WRITING ROLLER OF AN OFFICE MACHINE

The invention relates to a process for the discontinuous feeding in of recording carriers to the writing roller of an office machine as well as to an apparatus which makes possible such a process. Such an apparatus may be placed as an additional device onto an office machine in order to feed recording carriers stacked in at least one magazine selectively to the writing roller. The recording carriers may be sheets or envelopes which are stacked in different magazines. The apparatus may be driven in dependence on the rotational movement of the writing roller and requires no separate drive. The office machines may be, for example, automatic writers.

An apparatus of the previously mentioned type has been known, for example, from the German AS No. 28 57 074 or from the U.S. Pat. No. 4,248,415. In the case of this known apparatus which likewise feeds the sheets in only when needed, the separating apparatus is coupled with the writing roller in such a way that it will be driven by way of an overtaking free running member, whenever the writing roller is rotated against the direction of the pull-in of the paper, therefore backwards. As a result of such a function, the fed in sheet may not be pulled in during the feeding in process by the writing roller so that is it held back at the pull-in gap of the writing roller and is arched as a result of the forward movement of the separating apparatus. Only in the case of a reversal of the writing roller in the forward direction will the sheet be transported by the writing roller. As a result of such a mode of functioning, one is supposed to achieve that the sheet will assume a precisely defined starting position for the precise positioning of the lines prior to the reversal of the writing roller.

Basically however, the fact remains that for reasons of space, the sheet cannot be held in lateral guidances up to the actual clamping point or clamping line of the rollers forming the pulling-in gap, which is particularly of significance in the case of thin sheets. The pushing force exerted by the separating apparatus on the trailing section of the sheet may have for a consequence, because of the lack of a sufficient bending resistance even in the case of slight friction which acts on the advancing section of the sheet, a bending and evading of the sheet. Beyond that it is not possible in the case of most office machines to align the feeding in part tangentially to the rollers at the clamping point. Thus, there is no guarantee that the sheets and especially the forward edges come to a standstill always precisely in exactly the same position or in the case of the backward turning of the rollers, will always find the same position and alignment.

As a matter of fact in the case of the known apparatus, the danger exists that especially thin sheets, although still under the influence of the separating apparatus, will not reach the gap for drawing in for that reason or will come to a standstill in said gap. The reason for this lies not only in the fact that these sheets, because of a lack of the previously mentioned tangential alignment, strike with their forward edges the counterroller which together with the writing roller forms the pull-in gap. Since this roller—likewise for reasons of space—customarily has a considerably smaller diameter than the writing roller and in the case of the known apparatus moreover rotates backwards during the advance of the sheets through the separating arrangement, it might happen that the forward edge is not only fed in to the pull-in gap under the action of the friction of the roller, but is even deflected in the rotational direction of the roller. Whenever the sheet then comes to a standstill, it is not properly located. Even if, after completed reversal of the rotational direction, the counterroller is in a position to carry along the forward edge of the sheet in the direction of the pull-in gap and the pulling in of the sheet then takes place, for reasons of the faulty positioning, a writing error develops on the sheet. Besides the mentioned causes, a poor state of the sheets at their forward edges moreover is decisive or responsible for the fact that the sheet does not reach the pull-in gap with its forward edge. Whenever the forward edges of the sheets are slightly wavy or whenever they have been bent by the separating arrangement during the removal from the magazine or curved to some extent, then they will impede in any case the orderly introduction into the pulling in gap, and also the round arching of the sheets having arrived at a standstill as a result of the separating roller cannot guarantee that the forward edges will still reach the predetermined position.

From the German Patent No. 29 50 707 or from the already cited U.S. Pat. No. 4,248,415, it has been known that a stop lever, a control disc, a driving peg disposed on the control disc, a driving disc and an overtaking free running roller connected with it will be required as connecting elements for the coupling of the separating arrangement between a driver and a shaft of the separating arrangement. If one takes into consideration that the overtaking free running roller in addition still consists of a series of individual parts, then the expenditure of such connecting elements is relatively great.

In order to couple this known feed in apparatus, a threefold reversing of the writing roller is needed, whereby after the third reversal, during a backward run of the writing roller, therefore counter to the direction of the pull-in of the sheet, the separating arrangement will be driven by the writing roller. Only in the case of an additional reversal of the writing roller into the forward direction, will the sheet be transported by said writing roller.

From the British Patent No. 2,132,591, an apparatus is known for the feeding in of individual sheets from various magazines, whereby a separating arrangement is assigned to each magazine, of which arrangements each one may be triggered by way of a coupling arrangement by a programmed sequence of forward and backward rotational movements of the driving means. In contrast to the previously cited known arrangements, in the case of this known arrangement, the feeding in of the sheets takes place at a forward rotation. At the same time, however, no means have been stated in order to guarantee an exact positioning of the fed in sheets on a writing roller. Moreover, said apparatus known from the British patent requires a separate drive.

Therefore, the invention is based on the task in order to ensure a perfect and always uniform positioning of the sheets fed to the office machine in the pulling in gap or nip of the rollers to guide and secure each sheet in the pulling in gap, that the process of pulling in for this sheet always begins only whenever the rollers intended for the pulling in process begin with the pulling in movement.

Furthermore, it is the purpose of the invention in the case of an apparatus of the initially mentioned type to decrease the number of the connecting elements.

Furthermore, the invention is supposed to be suitable for the purpose of feeding in recording carriers from different magazines selectively to the writing roller of an office machine.

As a result of the invention, it is also supposed to be possible to do without an overtaking free running mechanism, as is required in the case of the apparatus according to the U.S. Pat. No. 4,248,415 as well as in the case of the British Patent No. 2,132,591.

The task set will be solved according to the invention by the characteristics stated in the patent claims.

A guidance of the sheet at its advancing section in the area of the pull-in gap or nip occurs as a result of the fact that the rollers at least during this part of the feeding in path move in the direction of the pulling in and thereby feed the advancing edge of the sheet also in that case to the nip, whenever the tangentiality of the feeding path is not given to the rollers in the clamping point or the sheets show irregularities at their forward edges. While with that, a first prerequisite for the correct positioning of the forward edge of each sheet in the pulling in gap has been fulfilled, another essential element of the invention lies in the fact that the actual positioning or the determination of position of the forward edge is not accomplished by pushing forces from a succeeding section of sheet, but by such forces which engage directly at a short section of the sheet encompassing the advancing edge. Thus, the thickness of the sheet has practically no influence on the capacity of ensuring a precise positioning of the advancing edge. The positioning moreover is accomplished automatically, since the backward rotation of the rollers forming the pull-in gap on the sheet or its advancing section is effective only for such a length of time as the latter is in the clamping range of the rollers. As soon as the sheet has left the clamping area, its advancing section also comes to a standstill. The position in which the sheet comes to a standstill is thus always the same.

The drawing in of the sheet with its advancing edge of the sheet during feeding, that is to say prior to positioning of it, is therefore accompanied by an advantageous side effect in that the rollers have a smoothening effect on this edge of the sheet. In the case of the positioning taking place after the pushing back as a result of the backward rotation of the rollers, the advancing edge of the sheet has passed twice into the clamping range of the rollers. Therefore, one can count with the fact that this edge of the sheet is directed straight and does no longer cause any positioning errors.

It may be effective to bring the sheet under tension during the pushing back, for example, through the fact that said sheet is braked at a succeeding section of the sheet. For this purpose, the certainty of the pulling precisely as to lines into the office machine may be further improved in certain cases. To this must be added that even slight slanting positionings of the sheet which may have resulted during the feeding in will be corrected by this measure with greater assurance. Since the tension applied, even though possibly to a variable degree, is effective over the entire width of the sheet, the advancing edge of the sheet will be brought in any case into a position parallel to the writing roller and the pulling in takes place simultaneously over the entire width of the sheet. The pulling in of the sheet from the direction of its advancing edge has for a consequence that also the succeeding sections of sheet will be aligned.

For the apparatus according to the invention, it is of considerable advantage that the rearward rotation of the rollers forming the pulling in gap, of which the one customarily is the writing roller of the office machine and is in driving connection with the separating arrangement of the supply magazine for the sheets that are to be fed in, will permit to act in a controlling manner on said driving connection. Thus, the forward feed of the paper may be interrupted by the separating arrangement at the movement of the rollers necessary for the positioning of the sheet without any additional control movement and may only be put into motion again, whenever there exists a need for a new sheet on the office machine.

Since the invention may be used especially also in the case of office machines in the case of which a multiplicity of supply magazines must be provided for possibly different sheets which always are called up according to selection, it is important for the arrangement that the coupling arrangement which in this case must be present in a number corresponding to the number of supply magazines, may be equipped very simply and at favorable cost.

Thus, the coupling arrangement may be provided in a very cost favorable manner by the fact that the means for engagement and the ratchet wheel on the one hand serve for the accomplishment of the driving connection and on the other hand do not hinder the pulling out of the sheet from the separating arrangement by a quicker running writing roller so that the necessity for an overtaking free running member is completely avoided.

In the case of a preferred form of embodiment, the means of engagement may be a ratchet lever disposed between the driver and a ratchet wheel. At the same time, the ratchet lever in connection with the driver on the one hand serves for the engagement and disengagement of the coupling arrangement and on the other hand as a means for engagement for the ratchet wheel.

As a result of a preferred form of embodiment in the case of which the return stoppage is formed by guide elements of the recording carriers and/or by a separating roller of the separating arrangement, it will be guaranteed that the sheet in the case of a temporary pushing out from the pulling in gap of the writing roller maintains an initial stress directed toward the pulling in gap. At the same time, it is possible that the sheet is either still in engagement with the separating arrangement, insofar as it has already left the separating arrangement a short time before, or is impeded by the guide elements, for example, an arched guide channel or a spring acting on the sheet, in pushing back in its stretched state. The engagement of the separating arrangement is interrupted in the case of recording carriers short in the direction of conveyance, for example, in the case of envelopes.

In the case of the apparatus according to the invention, the ratchet lever and the ratchet wheel are the only connecting elements required for the driving connection between the driver and the shaft of the separating arrangement. An essential characteristic of this solution is that the coupling in and the driving of the ratchet lever by the driver takes place in the case of a forward rotation of the writing roller, after the condition had been created for the engagement between the driver and the ratchet lever in the case of a preceding backward rotation of the writing roller by a predetermined rotational angle. For the introduction of the feed in process by establishing the driving-like connection, a twofold reversal of the writing roller will therefore be sufficient. The feeding in process will be completed by a short backward rotation of the writing roller, whereby the driver is put out of engagement with the ratchet lever. In the case of the succeeding forward rotation of the writing roller for the writing on process, the driver always remains out of engagement with the ratchet lever.

The solution according to the invention is not merely distinguished by an exact positioning of the fed in sheet for writing on precisely as to lines on the writing roller, but also by a relatively low expenditure of connecting elements for the production of the driving type connection of the writing roller up to the separating arrangement.

After the sheet that is to be conveyed has been taken from the magazine by the separating arrangement and has been fed to the writing roller, there takes place, as has already been mentioned, a backward rotation of the writing roller. This backward rotation on the one hand fulfills the already explained function, in order to align the sheet exactly by a repeated expulsion from the pulling in gap of the writing roller for the succeeding positioning, and it serves on the other hand for the dissolution of the driving connection between the writing roller and the separating arrangement.

In the case of a preferred embodiment in the case of which a driver stop cooperating with the driver and establishing a predetermined relative position between the driver and the ratchet lever has been provided, it is guaranteed that by the forward movement of the writing roller for the removal of the written on sheet, a starting position between the driver and the ratchet lever will be created, in order to ensure by the selection of the corresponding rotary angle in the case of the rearward rotation, the drive of the desired coupling arrangement.

In the case of a preferred embodiment, the ratchet lever in its uncoupled state is lifted off the ratchet wheel by a readjusting spring. At the same time, the shaft of the separating arrangement is without any driving type connection and therefore is freely rotatable in both rotational directions.

As has already been mentioned, as a result of that, an overtaking free run is superfluous and the ratchet is protected in its lifted up state. Furthermore, such an embodiment is particularly effective whenever the writing roller, for example, for producing graphics, is to be turned not only in a forward direction, but also in a backward direction without thereby also driving the separating mechanism. In order to avoid the fact that in the case of a backward rotation of the writing roller for the printing of graphics, one of the coupling arrangements is driven, means have been provided in order to disengage the driver arrangement in the case of a backward rotation in dependence on a predetermined rotational angle of the writing roller.

Embodiments by way of example of the invention will be explained in more detail on the basis of the drawings.

FIG. 2 shows the elements of a coupling arrangement;

FIG. 3 shows the coupling arrangement according to the FIG. 2 in an axial sectional view from above;

FIG. 4 is a schematic presentation for the control of the rotational direction toward the writing roller;

Figure 1:
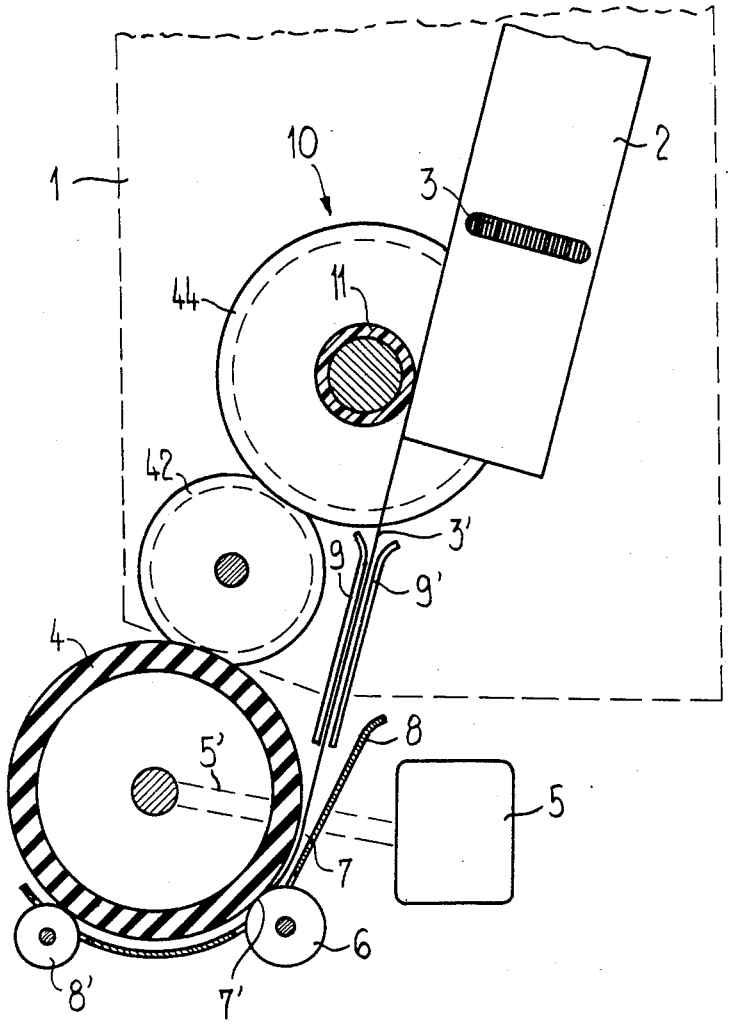
FIG. 1 shows an arrangement coupled with a writing roller for the feeding in of sheets to the writing roller.

The FIG. 1 shows an arrangement 1 for the feeding in of sheets 3 stacked in a magazine 2 to the writing roller or platen 4 of an office machine such as a printer or typewriter, not shown. The writing roller 4 which may be driven by a drive 5 with a program control arrangement by means of transfer elements 5', delimits jointly with a first contact roller 6 a sheet pulling in gap or nip 7 always for the sheet 3' that is fed in which pulling in gap 7 terminates in a clamping area 7' formed by the writing roller 4 and the first contact roller 6. By clamping range is meant here the terminally large area which also includes the theoretical clamping line and within which the distance of the surfaces of the rollers one from the other is smaller than the thickness of the sheet. A run-in metal guide sheet 8 and a second contact roller 8' are associated in a known manner as shown with the writing roller 4. The feeding in arrangement 1 has guide sheets 9 and 9' for guiding the sheet 3' in the direction of the pulling in gap 7.

The feeding arrangement 1 is placed in a known manner on an office machine and is coupled at the same time in a driving manner by way of a gear 42 with the writing roller 4 by which it is driven during rotation of the writing roller 4. For this purpose, the gear 42 meshes on the side of the feed arrangement 1 with a driving gear 44 of a coupling mechanism 10 by way of which at least a separating roller 11 of a separating apparatus may be driven. The separating roller 11 always draws the uppermost sheet 3' from the stack and guides it between the guide sheets 9 and 9' toward the nip 7. The coupling arrangement 10 may be engaged and disengaged always by a backward movement of the writing roller 4. The processes will be further explained on the basis of the succeeding Figures.

According to FIGS. 2 and 3, the coupling mechanism 10 is disposed on a shaft 12, shown in crosssection of the separating arrangement (FIG. 1) which has separating rollers connected torsionally with the shaft 12. Such a separating roller engaging on the paper stack is generally known. A ratchet wheel 14 is connected with the shaft 12 so as to be rotatable therewith. Furthermore, on the shaft 12, a driver disc 16 is mounted so as to be freely rotatably, in which disc a peg 18 has been disposed around which a ratchet lever 20 has been mounted swivelably. The ratchet lever 20 has a peg 22 which extends through a slit 24 disposed in the driver disc 16 up to the other side of the driver disc 16. On the other side, a tension spring 26 engages the peg 22 in order to hold the ratchet lever 20 with its ratchet 28 out of engagement away from the ratchet wheel 14. The tension spring 26 is relaxed by means of a peg 30 on the driver disc 16. The slit 24, one end of which is in contact with the peg 22, determines the rest position of the ratchet lever 20.

It is apparent from FIG. 3 that the driver disc 16 is mounted freely rotatably on the shaft 12. The shaft 12 on its part is mounted in a bearing 32 of a housing part 34 and is secured by a securing disc 36 lying against the bearing 32 against an axial shifting toward the right. Between the driver disc 16 and the bearing 32, a saddle disc 38 has been disposed on the shaft 12, which disc serves as a frictional brake for the driver disc 16 in order that the latter will not be driven as a result of the rotation of the shaft 12. As has already been mentioned, the ratchet wheel 14 is torsionally connected with the shaft 12 to rotate therewith.

On a fixed shaft 40 connected with the housing part 34, the gear 42 is mounted. This gear serves as a driving element for coupling with the writing roller 4 according to FIG. 1 or directly with its drive 5. The gear 42 meshes on the other hand with the driving wheel 44 mounted freely rotatable on the shaft 12 of the separating arrangement. The driving wheel 44 is secured against axial shifting on the shaft 12 by securing discs 46 and 48.

On the side facing the driving disc 16, on the driving wheel 44, a driver 52 is mounted swivelably on a peg 50. By means of an expansion spring 56 connected to an additional peg 54 inserted into the driving wheel 44, the driver 52 is held in a predetermined position but urged to rotate about pin 50 counterclockwise.

The FIG. 2 does not show a view cut according to FIG. 3, but merely serves for the schematic presentation of the relative position of the driver 52 of the ratchet lever 20 and of the ratchet wheel 14 in relation to one another. As has already been mentioned, the ratchet lever 20 is mounted on the driver disc 16 shown in FIG. 2, while the driver 52 is mounted on the driving wheel 44, not shown in FIG. 2.

It becomes clear from FIG. 2 that the driver 52 has an angulated arm 58 held in rest position by the spring 56. At its end, the arm 58 carries a driver projection 60 extending into the plane of the ratchet lever 20. With the exception of the driver projection 60, the ratchet lever 20 and the driver 52 are disposed in such a way in different planes that they do not touch during their mutual overlapping. In FIG. 3, the axial position of the driver arm 58 with its driver projection 60 is shown in broken line in relation to the ratchet lever 20.

The gear 42 (FIG. 3) with the writing roller, not shown, represents such a rotational connection that in the case of a forward rotation of the writing roller, there results a rotational direction as shown in FIG. 2 by 62. Between the driver 52 mounted on the driving wheel 44 and the writing roller 4 according to FIG. 1, there is a continuous driving connection. In the FIG. 2, a driver stop 64 is provided disposed on the driver disc 16, which cooperates with the driving projection 60. As a result of that, the driver disc 16 is continuously also rotated in the case of a forward rotation 62 of the writing roller. The driver stop 64 serves for the production of a predetermined relative position between the driver 52 and the ratchet lever 20. The driver stop 64 has slanting surfaces 64' and 64'' which serve for the purpose of forcing the driver projection 60 into its middle position in the case that the force of the spring 56, because of an increased friction of the driver 52 on the peg 50, is not sufficient.

The ratchet lever 20 has as an engaging means a recess 66 directed counter to the forward rotational direction 62 which recess is intended for the engagement of the driver projection 60 of the driver 52.

The function of the coupling arrangement will be explained in more detail on the basis of the FIGS. 4 to 7. Since prior to the feeding in of a new sheet, the writing roller has been turned in a forward direction 62, the relative position according to FIG. 2 is ensured, determined by the driver projection 60 and the driver stop 64. For the driving of the coupling arrangement 10, a backward rotation of the writing roller takes place now over the rotational angle designated with the arrow-line 68.

Figure 5:
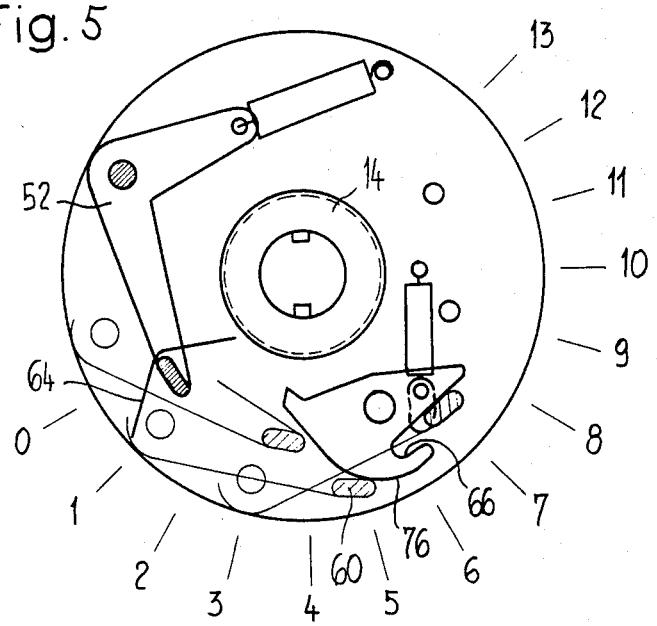
FIG. 5 shows the position of the functioning driving and engaging elements.

From the FIG. 5, it is apparent how the driver 52 glides with its driver projection 60 over the outside surface 76 of the ratchet lever 20, while the driving disc 16 remains stationary, until it engages stop 64. In the case of a subsequent forward rotation in the direction of the arrow 70' (FIG. 2), the driver projection 60 reaches the recess 66 and swivels said lever in a clockwise direction according to FIG. 6, until the ratchet 28 engages with the toothing 14' of the ratchet wheel 14 and carries the latter along. As a result of that, the driving connection is established in the case of a forward rotation of the writing roller between the writing roller and the separating arrangement symbolized by the shaft 12. As a result of that according to FIG. 1, the sheet 3' that is to be fed in will be pulled off by the separating arrangement 11 from the stack 3 and is fed to the area 7 of pulling in of the writing roller 4. At the same time, the writing roller is turned until the fed in sheet 3' is seized with its forward edge by the nip 7' of the writing roller 4 and is pulled in a few millimeters.

Figure 7:
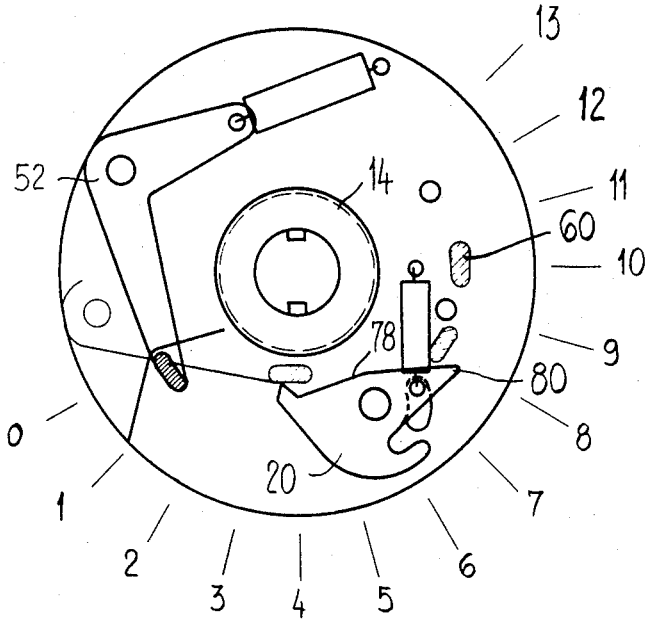
FIG. 7 shows the position of the functioning disengaging and conveying elements.

Then, the writing roller 4 is reversed in the direction of the arrow 72 whereby the driver projection 60 slips out of the recess 66 of the ratchet lever 20 and at the same time skips the rejecting point 80 of the ratchet lever 20 turned back counterclockwise, see FIG. 7. After that, the reversal of the writing roller into the forward direction according to the direction of the arrow 74 in FIG. 4 takes place, completing the feed in process. At the beginning of the forward rotation in the direction of the arrow 74, the driver projection 60 slides past the inside of the rejecting point 80 by way of the rejecting surface 78 of the ratchet lever 20 back into its starting position. The sheet 3' pushed back completely with its forward edge out of the clamping nip 7' is finally pulled into the clamping nip 7' and positioned on the writing roller 4 for being written on.

Figure 6:
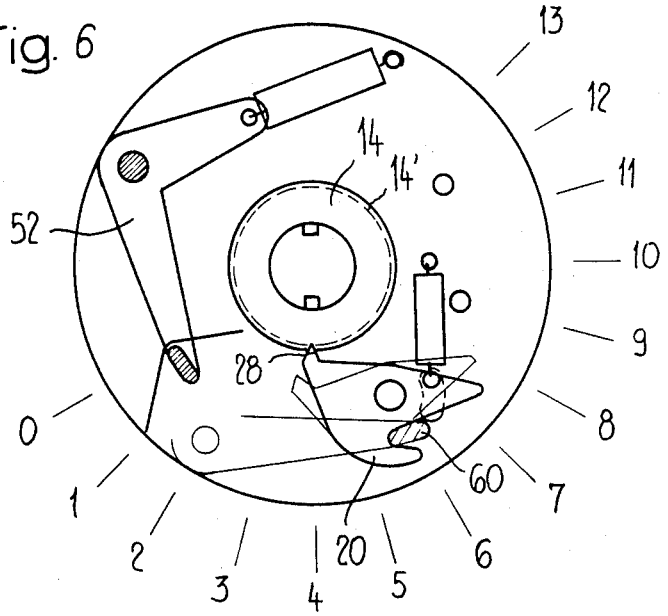
FIG. 6 shows the position of the functioning feeding in elements.

The line-steps or spaces of the writing roller which are required for the pertinent control functions have been designated with the numbers 0 to 13 in the FIGS. 5, 6 and 7. The line-step 0 designates the starting position of the driver projection 60. In the example of the embodiment according to FIGS. 2, 5, 6 and 7, a backward rotation by a distance of seven line-steps is required for hooking the driver projection 60 into the ratchet lever 20, see FIG. 5. In the case of the line-step 6, the engagement of the driver projection 60 into the recess 66 takes place. This one line-step is designated with 70' in the FIG. 2 and the FIG. 4.

According to FIG. 7, a backward rotation of four line-steps takes place, to wit, from 6 to 10, in order to ensure a secure uncoupling or releasing of a sheet's leading edge.

Figure 8:
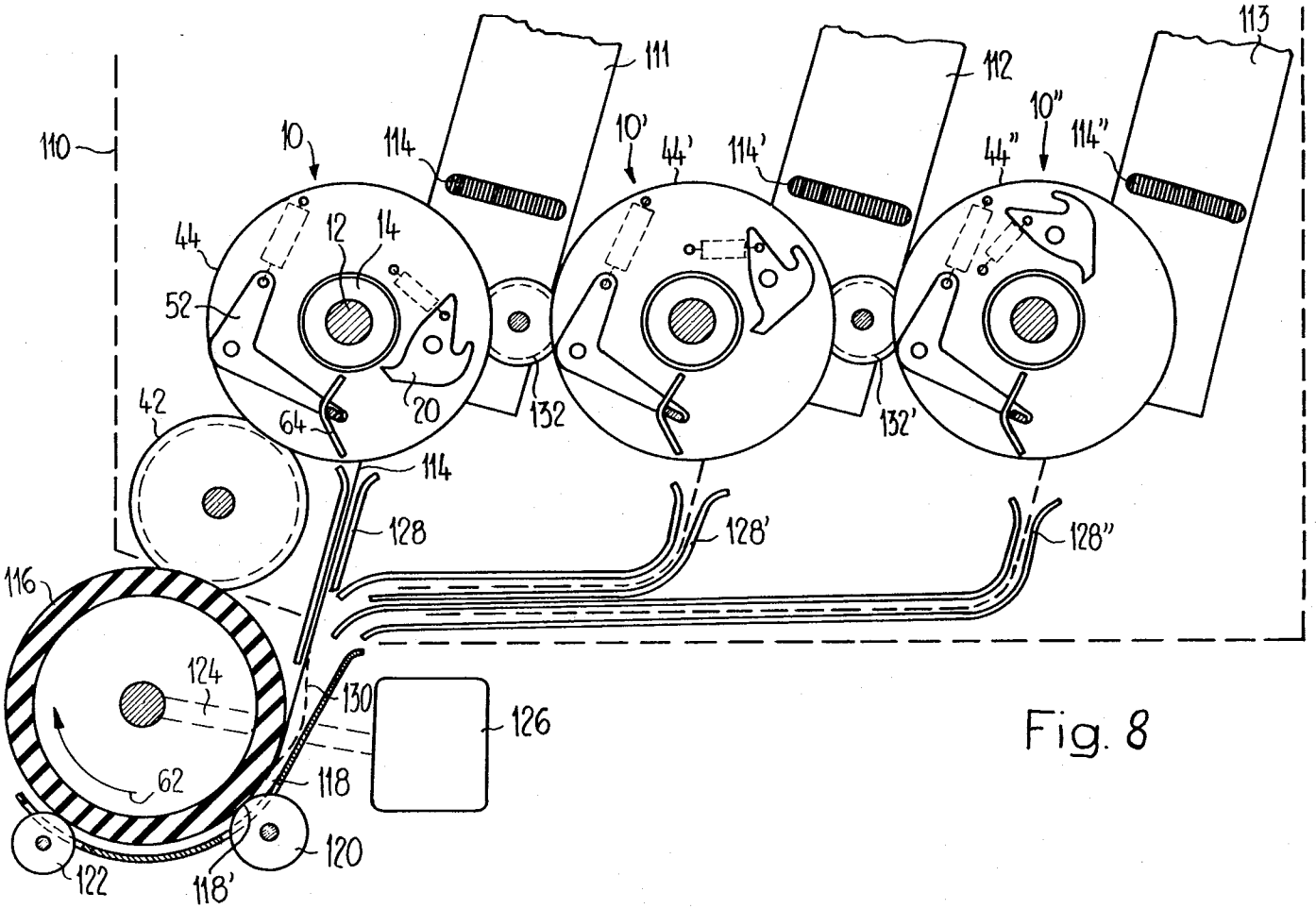
FIG. 8 shows a feeding arrangement for three magazines coupled with a writing roller.

In FIG. 8, an apparatus 110 has been shown which makes possible the feeding in of recording carriers 114 from three different magazines 111, 112 and 113. In order that the coupling arrangements 10, 10' and 10'' assigned to the magazines may be driven individually, the relative positions between the drivers 52 and the ratchet levers 20 are displaced about the respective shaft 12, for example, 7, 10 and 13 line-steps.

In the case of each triggering of one of the coupling arrangements 10, 10' or 10'', the drivers of all coupling arrangements are always moved. However, only that driver comes into engagement with the ratchet lever 20, the relative position of which agrees with the number of the turned back line-steps. Whenever, for example, the third coupling arrangement 10'' is triggered, then the drivers of the two first coupling arrangements 10 and 10' glide without engagement over the outside flank 76 of the ratchet levers 20.

The writing roller 116 shown in the FIG. 8 in cut and together with a first contact roller 120 will form the clamping nip 118'. The second contact roller is designated with 122. The writing roller 116 is driven by way of gear elements 124 by a controllable drive 126. The drive 126 is customarily program controlled, whereby the required turning angles for the driving of the desired coupling arrangement as well as for the additional control processes are stored. For example, in the case of the control, the variable paths from the magazine up to the writing roller must be taken into consideration.

The feeding in paths of the sheets from the magazines 111, 112, 113 up to the writing roller 116 are limited by guide elements 128, 128', 128'' which preferably are developed in such a way that they impede a backward transportation of the sheets. Such an impediment is desirable in order that in the case of pushing back of the advancing section of the sheet from the clamping gap 118' directly in front of the clamping gap and viewed in the direction of conveyance, a sufficient tension 130 is formed for the subsequent final pulling into the clamping gap.

As a result of the pushing back and the further short backward run of the rollers 116, 120, it will be possible to align the sheet 114 seized previously by the rollers with its forward edge precisely in parallel to the clamping gap 118'. As a result of that, the sheet being under tension is positioned exactly at the clamping nip so that in the case of a subsequent transportation in the forward direction, a writing precisely on the lines is ensured.

As had already been explained in connection with the FIG. 3, in FIG. 8, the coupling arrangement 10 is connected by way of a gear 42 with the writing roller 116. The two additional coupling arrangements 10' and 10'' are always connected in a driving manner with the driving wheel 44 or 44' of the preceding coupling arrangement by way of gears 132 and 132'.

Recording programs to be carried out by office machines often also contain the production of graphics or the like. For such operations, the English term "plotting" is used customarily. In the case of this operation, the sheet already pulled into the office machine must frequently also be moved backwards for which purpose the writing roller must carry out corresponding backward rotations. Within the scope of the apparatus according to the invention, it is now possible to make arrangements which will permit such an operating manner of the writing roller. These arrangements are to ensure that the backward rotation of the writing roller during "plotting" will not lead to an unintended driving of the coupling arrangement.

Figure 9:
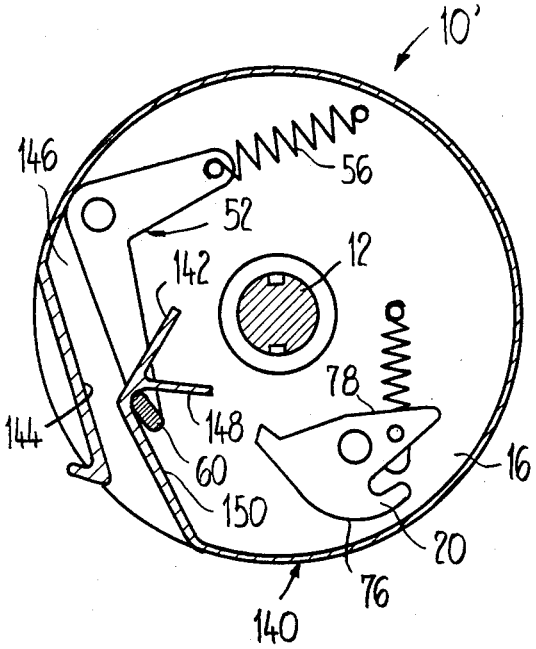
FIG. 9 shows a coupling arrangement suitable for graphic presentations on the writing roller.
Figure 10:
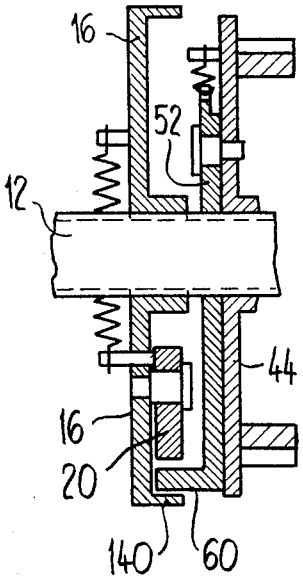
FIG. 10 shows the coupling arrangement according to FIG. 9 in a longitudinal cut.

As has already been mentioned, every backward rotation of the writing roller causes a rotation of the gear 42 as well as of the driving wheel 44 which carries the driver 52 (FIGS. 2, 3). In the case of a coupling arrangement 10''' developed for the "plotting" as illustrated in the FIGS. 9 and 10, the driver disc 16 carrying the ratchet lever 20 has an approximately spiral-like rejecting curve designated with 140 for the driver projection 60 of the driver 52. In the embodiment shown by way of example, this curve 140 extends beyond somewhat more than 360°. Since the extent of the curve determines the possible operating path during "plotting", i.e., the length of the section of the sheet usable for this purpose, it may be effective to allow the curve to extend in a spiral-shaped manner over several passages, for example, 1080°. It is also possible to develop the extent of the spiral precisely corresponding to the possible operating length at a predetermined length of the sheet.

The curve 140 has additional parts, namely, surfaces 142 and 144 which are spaced generally radially from each other and delimit a narrowing path 146. Finally, at the inside end of the curve, a driver stop has been formed by the surfaces 148 and 150 which correspond to the driver stop 64 of the embodiment according to FIG. 2 in reference to the function and general form.

Whenever the driving wheel 44 is rotated backwards and at the same time passes through a path which amounts to about 360°, then the driver 52 with its driver projection 60 has moved past the ratchet lever 20 on its side 76 facing the outside. In the case of a further rotation, the driver projection 60 will be released, the driver 52 being rotated counterclockwise about its pin by spring 56 as viewed in FIG. 9. Then, upon further backward rotation, the projection 60 reaches the surface 142 and will be deflected to the outside on said surface counter to the action of the spring 56. Whenever the driving wheel 44 now keeps turning backwards, then the driver projection runs out on the curve 140 and may cover a path along this curve corresponding to a full rotation. After completed reversal of the rotational direction of the writing roller and the forward movement of the sheet, the corresponding recording process may begin and possible take its course without any further reversal of the rotational direction until the driver projection has again reached the neighborhood of the run up surface 142. Irrespective of whether the writing roller moves forward or backward, or produces corresponding movements of the driving wheel, an unintended engagement of the driver projection at the ratchet lever is avoided as long as the projection is in the area of action of the curve 140. Whenever the "plotting" process has been completed, then the driver projection 60 is moved during the subsequent forward rotation of the driving wheel 44 past the inner rejecting surface 78 of the ratchet lever 20 into the starting position at the driver stop 148, 150. Thus, the readiness for the introduction of a renewed feeding in of a sheet is re-established.

The separating roller 11 pressing against the stack may serve for example as a reversal impediment for the sheet, provided the length of the sheet is sufficient in order to be in engagement at the same time still with the separating roller and with the writing roller. The guide channel 9—9' of the sheet may additionally serve as a return impediment, since a slight resistance will suffice in order to place the sheet in front of the pulling in gap 7 of the writing roller 4 under bending tension. Possibly baffles impeding the return may be disposed on the conveying path of the sheet to the writing roller, such as for example, leaf springs or else bristles.

In order to carry out the required rotational movement of the writing roller, program control arrangements serve for that purpose which are generally known and there is no need here to go into more detail about them. The feeding in arrangement according to the invention is adapted to these conditions which always may be engaged and disengaged as a result of a backward rotation of the writing roller. Such an embodiment is not bound to the embodiment shown by way of example, but may be developed by the expert as he wishes in order to achieve the same conditions.

What is claimed is:

1. A process for the discontinuous feeding and positioning of individual sheets to a nip defined by two adjacent rollers of an office machine where each sheet has a forward region including a leading edge and a following region and, when a sheet is to be fed, a force is applied to the following region to move the sheet toward the nip, comprising the steps of, during the moving of a sheet toward said nip, rotating the rollers in a paper feed forward direction to engage the leading edge of the sheet in the nip and rotating the rollers in the reverse direction at least until the leading edge of the sheet is moved out of the nip.

2. The process as claimed in claim 1 including the steps of advancing the leading edge of the sheet by rotation of said rollers in forward direction to engage said sheet in the nip between said rollers and to move said leading edge to a predetermined distance from the nip and rotating said rollers in reverse direction by a circumferential movement larger than length of sheet passed through the nip.

3. The process as claimed in claim 2 including the step of maintaining the sheet under tension during the step of moving the sheet back in a direction away from the nip.

4. A process for the selective feeding of a recording medium from at least one magazine containing a plurality of the recording media to a printing roller of an office machine where a recording medium feeder device is mounted on the office machine and is drivingly connected to the printing roller and which includes a coupling means in a drive path between the printing roller and a means for separating a medium from the plurality of media in the magazine, comprising the steps of:

(a) rotating the printing roller in a reverse direction a selected anglar degree to prepare for engagement of said coupling means and thereby said means for separating;

(b) rotating the printing roller in a forward direction through a selected angle substantially equal to engagement of said coupling means and to effect feeding of the medium from the magazine into the nip defined by the printing roller and a contact roller;

(c) rotating the printing roller in the reverse direction by a predetermined angle which is sufficient to disengage the coupling means and to push the medium including its leading edge completely out of the nip, the predetermined angle corresponding to a travel distance of the medium that is greater that the distance to which the medium extended through the nip; and (d) rotating the printing roller in the forward direction to pull the medium into the nip.

5. The process as claimed in claim 4, where the feeder device includes a plurality of magazines from each of which a recording medium can be fed to said printing roller, each feeder device having a coupling means and a separating means associated therewith, including the step of actuating a selected one of said coupling and separating means by rotating the printing roller through a selected reverse angle, each coupling and separating means being actuated by a different reverse angular rotation which corresponds to a relative positive between a driver and a ratched lever of said coupling means.

6. The process as claimed in claim 5, including the step of storing in a program control means the selected angles of reverse rotation for controlling the printing roller.

* * * * *